US009192839B2

(12) United States Patent
Klein

(10) Patent No.: US 9,192,839 B2
(45) Date of Patent: Nov. 24, 2015

(54) CORRECT FEET BATTING TRAINER

(71) Applicant: Charles Anthony Klein, Kenosha, WI (US)

(72) Inventor: Charles Anthony Klein, Kenosha, WI (US)

( * ) Notice: Subject to any disclaimer, the term of this patent is extended or adjusted under 35 U.S.C. 154(b) by 122 days.

(21) Appl. No.: 14/043,607

(22) Filed: Oct. 1, 2013

(65) Prior Publication Data

US 2015/0094172 A1 Apr. 2, 2015

(51) Int. Cl.

| | |
|---|---|
| ***A63B 69/00*** | (2006.01) |
| ***A63B 71/02*** | (2006.01) |
| *A63B 69/36* | (2006.01) |

(52) U.S. Cl.

CPC ..... *A63B 69/0002* (2013.01); *A63B 69/3673* (2013.01); *A63B 2069/0008* (2013.01)

(58) Field of Classification Search

CPC ..... A63B 69/0002; A63B 69/3667; A63B 69/0079; A63B 2220/17; A63B 69/3673; A63B 69/0024; A63B 2071/0627; A63B 69/0057; A63B 2069/0008; A63B 69/0013

USPC ..... 473/422, 452, 451, 270, 218, 272; D21/780, 698, 753

See application file for complete search history.

(56) References Cited

U.S. PATENT DOCUMENTS

| | | | | | |
|---|---|---|---|---|---|
| 3,342,487 | A * | 9/1967 | David | 473/452 |
| 3,994,501 | A * | 11/1976 | O'Donnell | 473/269 |
| 4,225,133 | A * | 9/1980 | Kiray | 473/457 |
| 4,516,772 | A * | 5/1985 | Stratton | 473/452 |
| 4,664,375 | A * | 5/1987 | Tetreault | 473/429 |
| D307,042 | S * | 4/1990 | Kathriner et al. | D21/780 |
| 4,932,656 | A * | 6/1990 | Pierce | 473/452 |
| 5,037,094 | A * | 8/1991 | Johnson | 473/452 |
| 5,318,290 | A * | 6/1994 | Sawyer | 473/452 |
| 5,613,677 | A * | 3/1997 | Walker, Jr. | 473/452 |
| 6,500,078 | B1 * | 12/2002 | Williams et al. | 473/452 |
| D569,943 | S * | 5/2008 | Greene | D21/780 |
| 7,374,520 | B1 * | 5/2008 | Licari | 482/144 |
| 7,468,010 | B2 * | 12/2008 | Du Brock | 473/452 |
| 7,775,914 | B1 * | 8/2010 | Greene | 473/452 |
| 8,617,009 | B2 * | 12/2013 | Golom | 473/452 |
| 2007/0060421 | A1 * | 3/2007 | Distefano | 473/452 |
| 2012/0302363 | A1 * | 11/2012 | Miller et al. | 473/269 |
| 2013/0274035 | A1 * | 10/2013 | St. Claire | 473/421 |

* cited by examiner

*Primary Examiner* — Mitra Aryanpour

(74) *Attorney, Agent, or Firm* — Ryan Kromholz & Manion, S.C.

(57) ABSTRACT

A batting trainer device that may be placed near a batter's rear foot and discourages the batter from over-rotating the rear foot. The device having a planar base member, a planar backing member, and a heel stop. The planar base member may be rotatably affixed to the planar backing member, and the heel stop may be removably affixed to the backing member. The backing member position relative to the base member may be adjustable with an adjustment means.

20 Claims, 5 Drawing Sheets

CORRECT FEET BATTING TRAINER

BACKGROUND OF THE INVENTION

Hitting a baseball or softball is one of the most challenging propositions in all of sport. Consistency and balance are two key factors for having a good swing and for being productive at the plate. Generally, balance comes first as it sets up a solid foundation for the remaining mechanics to take shape, such as the "cocking" of the hips, transferring of power from the legs through the body and to the bat, and following through. Once a player develops a balanced swing, consistency is short to follow.

Having a balanced swing also places a player in a good position for sprinting out of the batter's box after making contact with the ball. As baseball can be a game of inches and seconds in a "bang-bang" play, any wasted movement trying to regain balance out of the batter's box takes time to correct and may result in a hitter being thrown out.

Moreover, foot movement during the swing is instrumental in determining whether a swing is balanced or not, especially movement of the back foot. Many good hitters finish the swinging motion on the ball of their back foot, the foot rotated approximately 90°, and not far from where it started, if it moved at all. This places the hitter in the optimal position for accelerating out of the batter's box. When a hitter rotates the back foot over 90° it twists the knee. The player must then rotate the foot back before putting weight on it to push off when launching out of the batter's box towards first base. A balanced and consistent swing takes practice; therefore, a device that discourages rotation of the back foot over 90° will go a long way in making practice more effective.

SUMMARY OF THE INVENTION

The present invention relates to a practice device which discourages rotation of a hitter's back foot past 90°. The device comprises a base member, an upstanding wall extending from the base member, and a flange protruding from the upstanding wall. Whereby the flange makes contact with a hitter's foot if about to rotate past 90°.

One aspect of the present invention provides a batting trainer having a substantially planar base member comprising a base member front end, a substantially planar backing member comprising a backing member front surface and a backing member bottom edge adjacent to the backing member front surface and adjoining the base member front end, and a heel stop having a heel stop length comprising a heel stop laterally extending member extending along the heel stop length and a heel stop connecting member substantially perpendicularly adjoined to the heel stop laterally extending member and extending along the heel stop length; wherein the heel stop is affixed to the backing member with the heel stop connecting member lying against the backing member front surface; the heel stop length substantially perpendicular to the backing member bottom edge and the heel stop laterally extending member protruding outward from the backing member front surface.

The batting trainer may also have a backing member first side and a backing member second side, wherein the heel stop is affixed to at least one of the backing member first side and the backing member second side.

The batting trainer may also have the base member front end operatively connected to the backing member bottom edge for rotation of the backing member relative to the base member and further comprising an adjustment mechanism.

The adjustment mechanism may comprise a two-arm adjustment mechanism.

The adjustment mechanism may comprise a hinge adjustment mechanism.

The adjustment mechanism may comprise a ladder adjustment mechanism.

The batting trainer may also have a movement limiting mechanism.

The movement limiting mechanism may comprise a weighted bag.

The movement limiting mechanism may comprise a free-weight mechanism.

The movement limiting mechanism may comprise a stake mechanism.

The batting trainer may also have a handle.

Another aspect of the present invention provides a method of batter training comprising the steps of providing a batting trainer comprising a backing member and a heel stop comprising a laterally extending member; wherein the heel stop is affixed to the backing member; and impeding over rotation of a batter's foot with the laterally extending member.

The method of batter training may also comprise the steps of providing a movement limiting mechanism and applying the movement limiting mechanism to the batting trainer to impede movement of the batting trainer.

The movement limiting mechanism of the method of batter training may comprise a weighted bag.

The movement limiting mechanism of the method of batter training may comprise a free-weight mechanism.

The movement limiting mechanism of the method of batter training may comprise a stake mechanism.

The method of batter training may also comprise the steps of providing the batting trainer further comprising a base member operatively connected to the backing member for rotation of the backing member relative to the base member and an adjustment mechanism, and adjusting the backing member position relative to the base member.

The adjustment mechanism of the method of batter training may comprise a two-arm adjustment mechanism.

The adjustment mechanism of the method of batter training may comprise a hinge adjustment mechanism.

The adjustment mechanism of the method of batter training may comprise a ladder adjustment mechanism.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
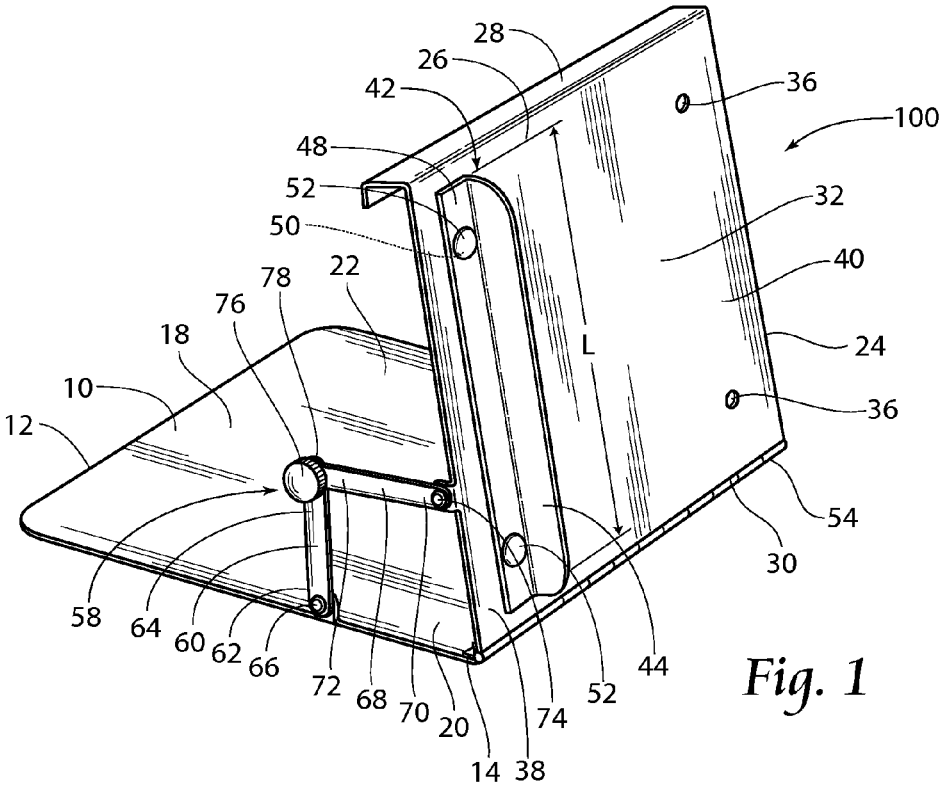
FIG. 1 is a perspective view of a first embodiment of the batting trainer according to the present invention.
Figure 2:
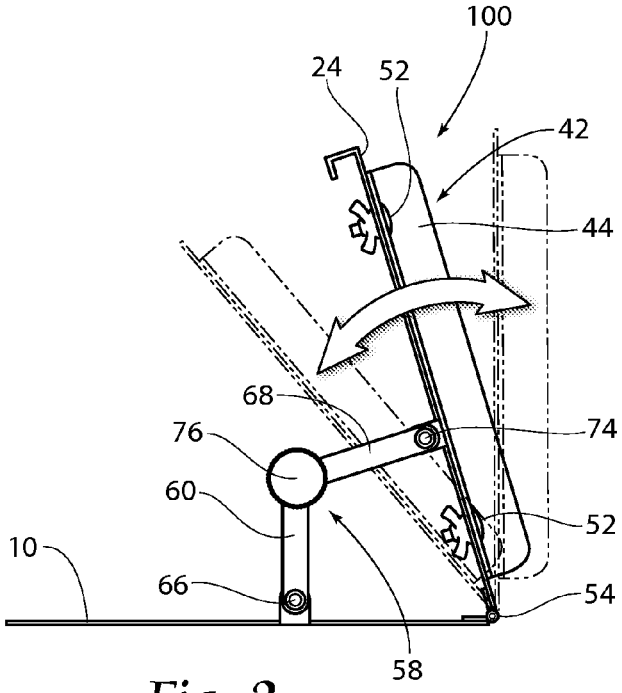
FIG. 2 is a side view of the batting trainer of FIG. 1 illustrating multiple positions.

Looking to FIG. 1, an embodiment of a batting trainer 100 is shown. The batting trainer 100 shown here has a planar base member 10, a planar backing member 24; a heel stop 42, a hinge 54, and an adjustment mechanism comprising a two-arm adjustment mechanism 58.

According to the present invention, the planar base member 10 has a back end 12, a front end 14, a first side 20, a second side 22, and a top surface 18. The base member 10 may be comprised of a durable light weight metal or plastic, for instance, aluminum, as a non-limiting example of a potential metal.

The planar backing member 24 has a top end 26, a bottom edge 30, a front surface 32, a rear surface 34 (see FIG. 8), a first side 38, and a second side 40. Additionally, an overhang 28 extends from the top end 26 substantially perpendicular to the backing member 24 and over the rear surface 34. Furthermore, at least one aperture 36 is located on at least one of the first side 38 and the second side 40. Similarly to the base member 10, the backing member may be comprised of a durable light weight metal or plastic.

The planar base member 10 and the planar backing member 24 may be joined at their respective front end 14 and bottom edge 30 by a hinge 54. The hinge 54 allows the base member 10 and the backing member 24 to rotate relative to one another.

An adjustment mechanism, shown in FIG. 1 as a two-arm adjustment mechanism 58, comprises a base arm 60 and a backing arm 68. The base arm 60 has a first end 62 oppositely disposed from a second end 64. The first end 62 is rotatably affixed to a base arm joint 66 located on the first side 20 of the base member 10. The backing arm 68 has a first end 70 oppositely disposed from a second end 72. The first end 70 is rotatably affixed to a backing arm joint 74 located on the first side 38 of the backing member 24. The base arm second end 64 and the backing arm second end 72 are rotatably joined together by a knob 76 at a junction point 78. The knob 76 may comprise a threaded rod (hidden) extending therefrom which interfaces with a nut (not shown) or threads within the base arm second end 64 or the backing arm second end 72 at the junction point 78.

Additionally, it is contemplated that another two-arm adjustment mechanism 58 may be employed on the base member and backing member second sides 22, 40 of the batting trainer 100, or exclusively on the base member and backing member second sides 22, 40. Furthermore, the knob 76 may be positioned at the base arm joint 66 or the backing arm joint 74 and still be within the purview of the present invention.

Continuing to look at FIG. 1, a heel stop 42 is shown affixed to the first side 38 of the backing member 24. The heel stop 42 has a length L, a connecting member 48 extending substantially along the length L, and a laterally extending member 44 extending substantially along the length L adjoining and perpendicular to the connecting member 48. The connecting member 48 has at least one hole 50 for alignment with the at least one backing member aperture 36. Removable connectors 52 may be inserted through the at least one hole 50 and the at least one backing member aperture 36 to secure the heel stop 42 to the backing member 24 preferably with the heel stop length L substantially perpendicular to the backing member bottom edge 30. Thereby the laterally extending member 44 protrudes from the backing member front surface 32 also substantially perpendicular with the backing member bottom edge 30. As shown in FIG. 1, the heel stop 42 is in a position for a batter 90 batting right-handed (see FIG. 3), because it is positioned on the backing member first side 38.

Furthermore, a user 90 (see FIG. 3) may adjust the angle of the backing member 24 relative to the base member 10 about hinge 54 and secure a preferred orientation using the two-arm adjustment mechanism 58. When the knob 76 is in a disengaged position, the two arms 60, 68 may rotate about the junction point 78 and their respective arm joints 66, 74. The hinge 54 may be of any type known in the art capable of performing the function as described herein.

After the user positions the backing member 24 in the preferred orientation, the user may "lock" the base arm 60 and the backing arm 68 together by turning the knob 76 in an engaging direction. Friction between the base arm 60 and the backing arm 68 or interfacing teeth (not shown), or another engaging means capable of substantially preventing movement of base arm 60 and the backing arm 68 are contemplated. When the knob 76 is engaged, the two-arm adjustment mechanism 58 is substantially prevented from rotational movement.

Figure 3:
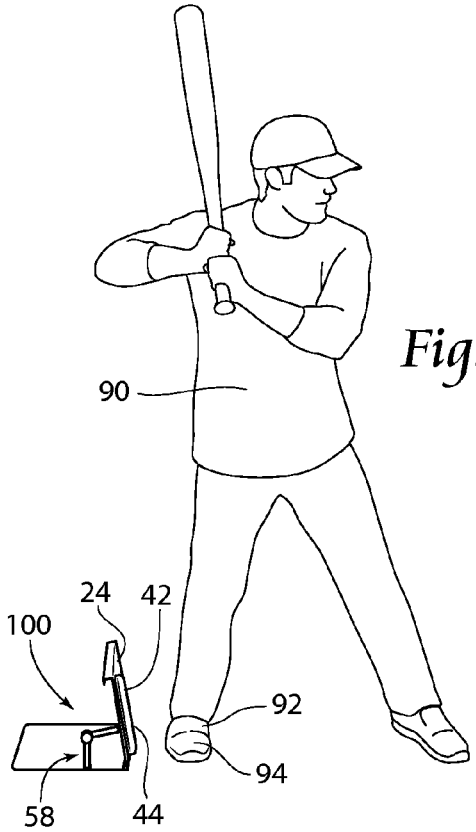
FIG. 3 is a side view illustration of the batting trainer of FIG. 1 with a hitter in a pre-swing position.
Figure 4:
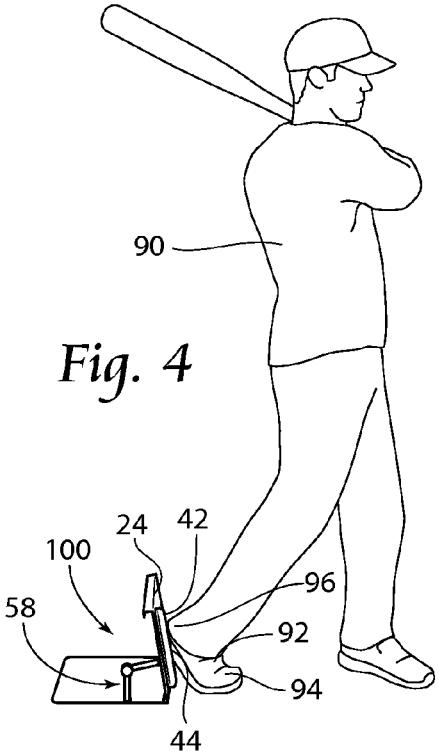
FIG. 4 is a side view illustration of the batting trainer of FIG. 1 with a hitter in a post-swing position.
Figure 5:
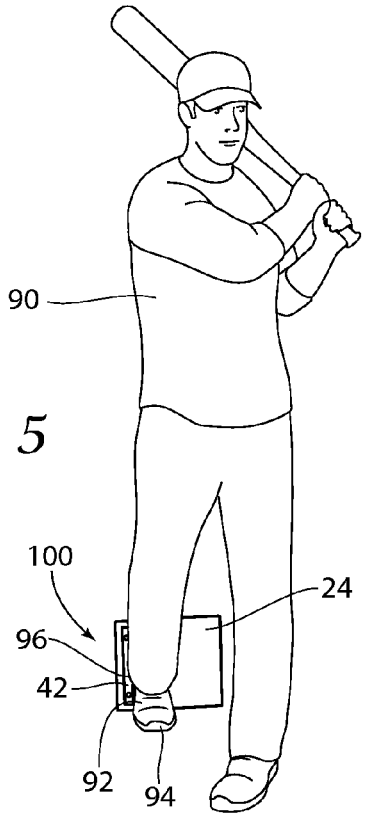
FIG. 5 is a front view illustration of the batting trainer of FIG. 1 with a hitter in a post-swing position.
Figure 8:
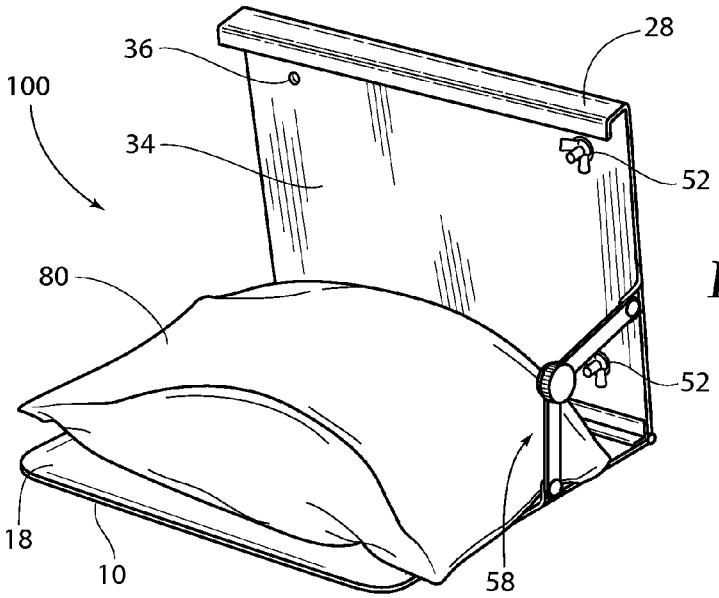
FIG. 8 is a rear perspective view of the batting trainer according to the present invention illustrated in FIG. 1 with an embodiment of a movement limiting mechanism according to the present invention.

FIGS. 3 through 5 illustrate the batting trainer 100 set up for a right-handed batter 90 as described earlier. The batting trainer 100 may be used for batting left-handed as well by moving the heel stop 42 from the backing member first side 38 to the backing member second side 40. With reference to FIGS. 1 and 8, this is done by removing the connectors 52 from the heel stop 42 and backing member 24, transferring the heel stop 42 to the backing member second side, and reinstalling the connectors 52 through the heel stop connecting member 48 and the apertures 36, and securing the heel stop 42 to the backing member 24.

In use, the batting trainer 100 is placed on the ground near the batter's rear foot 92. A starting position is shown in FIG. 3, whereby the toes 94 of the hitter's rear foot 92 are approximately lined up with the heel stop 42. As the batter 90 swings, his rear foot 92 rotates. As seen in FIGS. 4 and 5, at approximately 90 degrees from the starting position the batter's heel 96 may make contact with the heel stop laterally extending member 44, thus impeding the batter 90 from over-rotating his rear foot 92.

As discussed previously, the backing member 24 may be rotated relative to the base member 10. Adjustability of the backing member 24 may be advantageous for hitters of different ages and/or skill level. Novice hitters may require a less upright backing member 24 because they may be primarily learning how to rotate their back foot 92 properly, with a lower emphasis on heel height. As the hitter advances in skill, more emphasis may be placed on a higher heel height during the development of transferring power from the back foot 92 through body and through the swing. In that regard, the backing member 24 of the batting trainer 100 may be positioned in a more upright manner. Therefore, adjustability of the position of the backing member 24 relative to the base member 10 provides added variation for different skill levels and training exercises.

Figure 6:
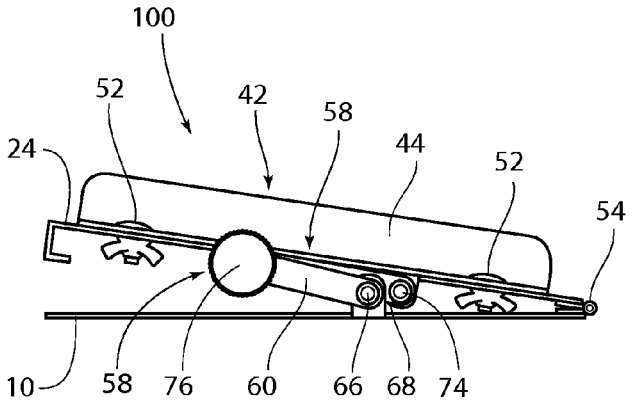
FIG. 6 is a side view of the batting trainer of FIG. 1 in a collapsed position.
Figure 7:
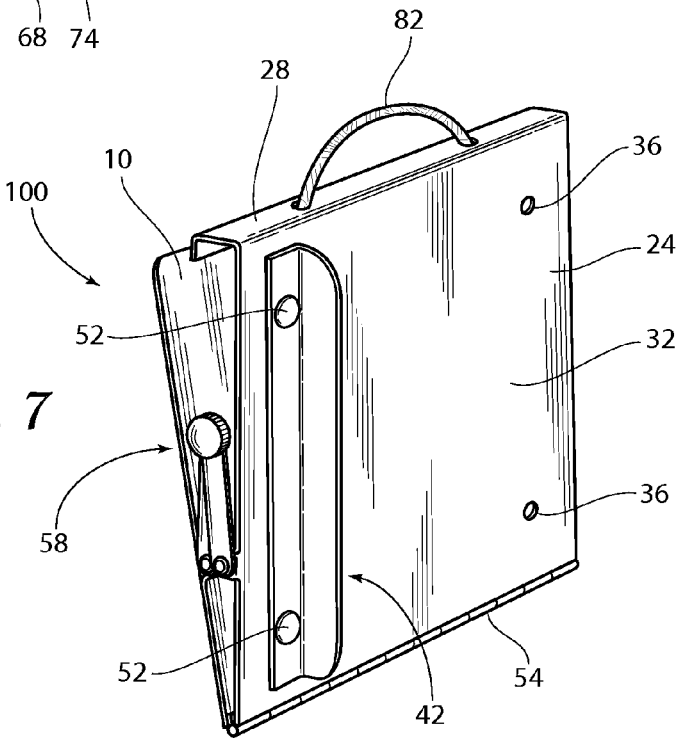
FIG. 7 is a perspective view of the batting trainer of FIG. 1 in a collapsed position with a handle.

As shown in FIG. 6, the batting trainer 100 may also be easily collapsed to be more compact for transport or for general storage. When in the collapsed position the two-arm adjustment mechanism 58 may be tightened to discourage the batting trainer 100 from opening. Furthermore, as shown in FIG. 7, a handle 82 may be incorporated into the overhang 28 for easier transporting of the batting trainer 100.

Furthermore, it may be desired to provide a movement limiting mechanism to limit movement of the batting trainer 100 during use, because the heel 96 of the hitter 90 will likely make repeated contact with the heel stop 42 of the batting trainer 100. However, it may also be desired to allow for the batting trainer 100 to move or rotate out of the way when hit by a larger force, like a misstep by the batter 90, to prevent or reduce the likelihood of injury. As shown in FIG. 8 the movement limiting mechanism comprises a weighed bag 80 placed on the top surface 18 of the base member 10. Placement of the weighted bag 80 on the base member 10 discourages movement of the batting trainer 100 during normal use, but will not completely prevent it from moving if a larger force is experienced.

Figure 9:
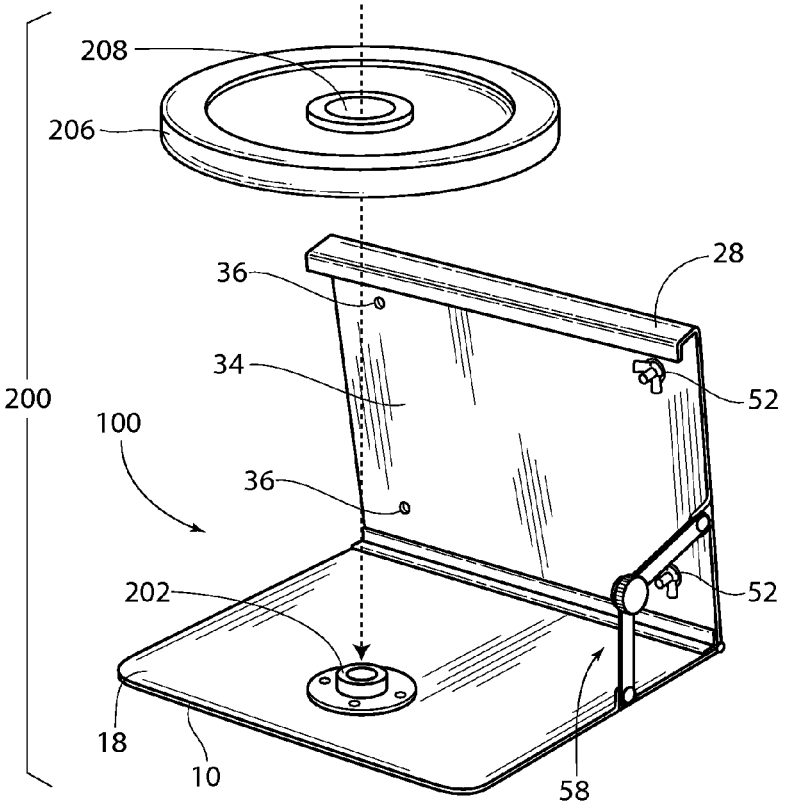
FIG. 9 is a rear perspective view of the batting trainer similar to FIG. 8 but illustrating an alternative movement limiting mechanism according to the present invention.

Furthermore, FIG. 9 depicts an alternative movement limiting mechanism comprising a free-weight mechanism 200. The free-weight mechanism 200 comprises a receiver 202 affixed to the top surface 18 of the base member 10 using any means known to those having skill in the art and a weight plate 206 with a hole 208. The weight plate 206 may be used to discourage movement of the batting trainer 100 wherein the receiver 202 is received by the weight plate hole 208. Additionally, the interface between the receiver 202 and the weight plate hole 208 prevents the batting trainer 100 from moving out from underneath the weight plate 206. In addition, it may be desired to locate the receiver 202 closer to the back end 12 of the base member 10 to provide room for larger diameter weight plates 206.

Figure 10:
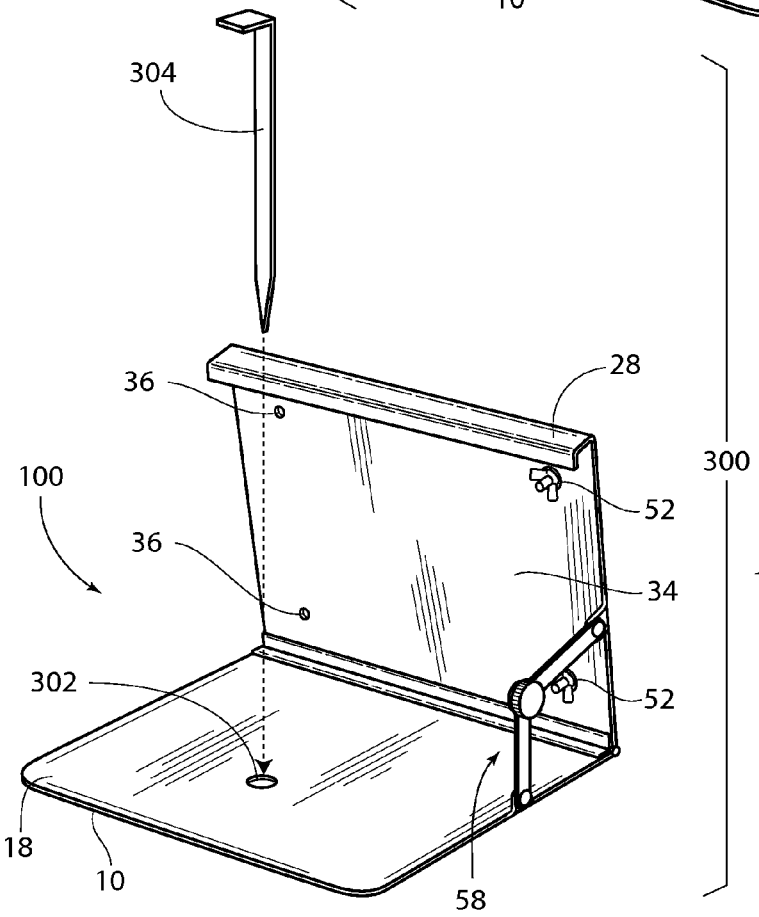
FIG. 10 is a rear perspective view of the batting trainer similar to FIG. 8 but illustrating an alternative movement limiting mechanism according to the present invention.

Moreover, FIG. 10 illustrates another alternative movement limiting mechanism comprising a stake mechanism 300. The stake mechanism 300 comprises at least one stake 304 and a hole 302 positioned in the base member 10. The stake mechanism 300 may be used to physically secure the batting trainer 100 by inserting the stake 304 through the hole 302 and into the ground. This may be desired if using the batting trainer 100 on grass or another surface which has a lower coefficient of friction.

Figure 11:
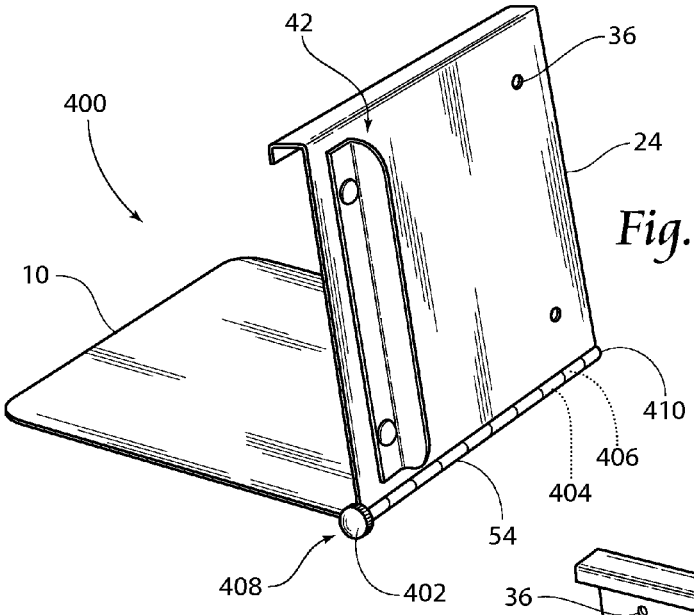
FIG. 11 is a front perspective view of a second embodiment of a batting trainer similar to FIG. 1 but illustrating an alternative adjustment mechanism according to the present invention.

Looking now to FIG. 11 in which a second embodiment 400 of the batting trainer is shown. Here an alternative adjustment mechanism comprising a hinge adjustment mechanism 402 comprising a threaded rod 404 (hidden), a knob 408 connected to one end of the threaded rod 404, and a receiving end 410 which interfaces with the threads 406 (hidden) of the threaded rod 404. When the knob 408 is turned in an engaging direction the hinge 54 tightens in on itself, thus increasing the friction in the hinge 54 and inhibiting movement of the backing member 24 relative to the base member 10. When the knob 408 is turned in a disengaging direction, the friction is reduced and the backing member 24 may be permitted to rotate relative to the base member 10.

Figure 12:
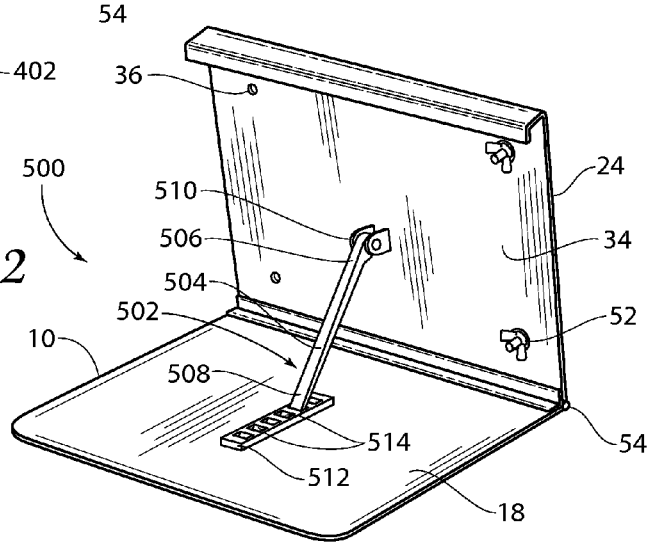
FIG. 12 is a rear perspective view of a third embodiment of a batting trainer similar to FIG. 1 but illustrating an alternative adjustment mechanism according to the present invention.

Furthermore, FIG. 12 illustrates a third embodiment 500 which employs an alternative adjustment mechanism comprising a ladder adjustment mechanism 502 comprising a bar 504 having a first bar end 506 and a second bar end 508, wherein the first bar end 506 is rotatably affixed to a pivot 510 located on the rear surface 34 of the backing member 24 and the second bar end 508 alignable with one of a plurality of spaces 514 in a ladder 512 situated on the top surface 18 of the base member 10. Therefore, the orientation of the backing member 24 relative to the base member 10 may be adjusted by placing the second bar end 508 in a different space 514. Moreover, it should be noted that the position and/or location of the ladder adjustment mechanism 502 should not be construed as limited to only that described.

Figure 13:
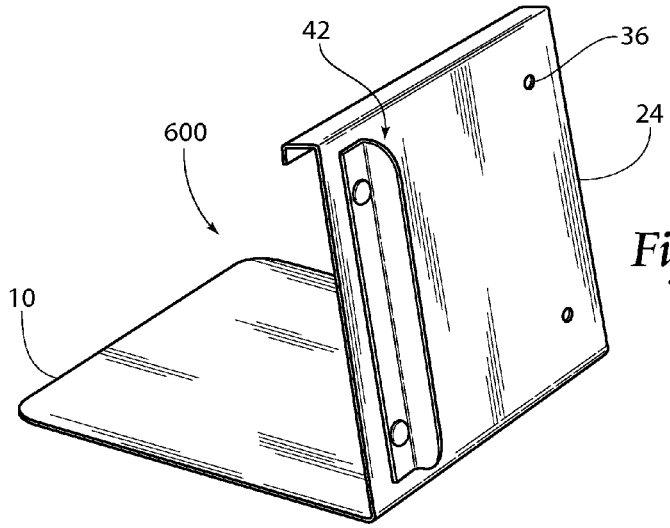
FIG. 13 is a front perspective view of a fourth embodiment of a batting trainer similar to FIG. 1 without an adjustment mechanism according to the present invention.

Additionally, FIG. 13 illustrates a fourth embodiment 600 of the present invention having a preset orientation with the backing member 24 in a fixed relationship with the base member 10. This may be desired by users that do not need to adjust the backing member 24 relative to the base member 10.

Furthermore, it is contemplated that the batting trainer embodiments 100, 400, 500, and 600 may comprise any or all of the movement limiting mechanisms disclosed herein without limitation in addition to being provided in the method of use described above with any or all of the movement limiting mechanisms.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A batting trainer comprising:

a substantially planar base member comprising a base member front end;

a substantially planar backing member comprising a backing member front surface and a backing member bottom edge adjacent to the backing member front surface and adjoining the base member front end; and a heel stop having a heel stop length comprising a heel stop laterally extending member extending along the heel stop length and a heel stop connecting member substantially perpendicularly adjoined to the heel stop laterally extending member and extending along the heel stop length;

wherein the heel stop is affixed to the backing member with the heel stop connecting member lying against the backing member front surface; the heel stop length substantially perpendicular to the backing member bottom edge and the heel stop laterally extending member protruding outward from the backing member front surface.

2. The batting trainer of claim 1, further comprising a backing member first side and a backing member second side, wherein the heel stop is affixed to at least one of the backing member first side and the backing member second side.

3. The batting trainer of claim 1, wherein the base member front end operatively connected to the backing member bottom edge for rotation of the backing member relative to the base member and further comprising an adjustment mechanism.

4. The batting trainer of claim 3, wherein the adjustment mechanism comprises a two-arm adjustment mechanism.

5. The batting trainer of claim 3, wherein the adjustment mechanism comprises a hinge adjustment mechanism.

6. The batting trainer of claim 3, wherein the adjustment mechanism comprises a ladder adjustment mechanism.

7. The batting trainer of claim 1 further comprising a movement limiting mechanism.

8. The batting trainer of claim 7, wherein the movement limiting mechanism comprises a weighted bag.

9. The batting trainer of claim 7, wherein the movement limiting mechanism comprises a free-weight mechanism.

10. The batting trainer of claim 7, wherein the movement limiting mechanism comprises a stake mechanism.

11. The batting trainer of claim 1, further comprising a handle.

12. A method of batter training comprising the steps of:

selecting a batting trainer comprising;

a substantially planar base member comprising a base member front end;

a substantially planar backing member comprising a backing member front surface and a backing member bottom edge adjacent to the backing member front surface and adjoining the base member front end; and a heel stop having a heel stop length comprising a heel stop laterally extending member extending along the heel stop length and a heel stop connecting member substantially perpendicularly adjoined to the heel stop laterally extending member and extending along the heel stop length;

wherein the heel stop is affixed to the backing member with the heel stop connecting member lying against the backing member front surface; the heel stop length substantially perpendicular to the backing member bottom edge and the heel stop laterally extending member protruding outward from the backing member front surface; and impeding over rotation of a batter's foot with the laterally extending member.

13. The method of batter training according to claim 12 further comprising the steps of:

selecting a movement limiting mechanism; and applying the movement limiting mechanism to the batting trainer to impede movement of the batting trainer.

14. The method of claim 13 wherein the movement limiting mechanism comprises a weighted bag.

15. The method of claim 13 wherein the movement limiting mechanism comprises a free-weight mechanism.

16. The method of claim 13 wherein the movement limiting mechanism comprises a stake mechanism.

17. The method of batter training according to claim 12 further comprising the steps of:

selecting the batting trainer further comprising a base member operatively connected to the backing member for rotation of the backing member relative to the base member and an adjustment mechanism; and adjusting the backing member position relative to the base member.

18. The method of claim 17 wherein the adjustment mechanism comprises a two-arm adjustment mechanism.

19. The method of claim 17 wherein the adjustment mechanism comprises a hinge adjustment mechanism.

20. The method of claim 17 wherein the adjustment mechanism comprises a ladder adjustment mechanism.

* * * * *